United States Patent [19]

Henry

[11] 4,028,741

[45] June 14, 1977

[54] PLASTIC BLOUSING BLOCK

[76] Inventor: William P. Henry, 567-82-9227, Box 80, B Co., 2nd Bn., 6th Inf., A.P.O. New York, N.Y. 09742

[22] Filed: May 4, 1976

[21] Appl. No.: 682,838

[52] U.S. Cl. ..... 2/232

[51] Int. Cl.[2] ..... A41D 1/06

[58] Field of Search ..... 2/311, 320, 321, 232, 2/232 A, 300, 302, 312; 223/72, 74

[56] References Cited

UNITED STATES PATENTS

| | | | |
|---|---|---|---|
| 2,000,149 | 5/1935 | Reich | 2/232 X |
| 2,962,724 | 12/1960 | Wilkens | 2/311 X |

*Primary Examiner*—G. V. Larkin

*Attorney, Agent, or Firm*—Dana E. Keech

[57] ABSTRACT

A split plastic tubular annulus about five inches in length and six inches in diameter which is manufactured to be spring biased to cause interlocking terminal edges to interengage but being of a springy resiliency allowing the annulus to be sprung apart manually and thus fitted around a soldier's leg above a boot worn on the foot thereof and beneath a pantsleg thereabove, following which the pantsleg is drawn downward over the annulus and tucked inside said boot whereupon, when the boot is laced over the pantsleg, the annulus gravitates into the pantsleg, blocking out the latter at the level of the top of the boot.

1 Claim, 4 Drawing Figures

PLASTIC BLOUSING BLOCK

SUMMARY OF THE INVENTION

The tucking of a soldier's pantsleg into his field boots is an ancient practice and many expedients have been devised by the soldiers to dress up the bagging of the pantsleg at the level of the boot tops. Cardboard rings of various styles termed "blousing blocks" are included among such devices but difficulty is generally experienced in producing a uniform blousing effect due to variations in these expedients.

It is an object of the present invention to provide a plastic blousing block comprising a springy split annulus which is manufactured in three or more sized (as required) and which may be readily expanded manually to receive a soldier's leg therewithin, the device being spring biased to cause its terminal edge to then come together, thus maintaining the device in its assembled character of a tubular annulus after being applied around the leg.

Another object of the invention is to provide such a blousing block in which snap action interlocking means are provided on said terminal edges which resist separation of said edges, once interlocked, by any normally anticipatable accidental pressure thereagainst.

DETAILED DESCRIPTION OF THE PREFERRED EMBODIMENT

Figure 1:
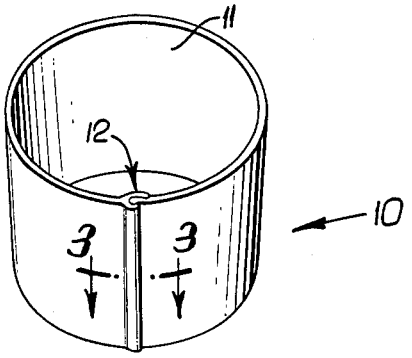
FIG. 1 is a perspective view of a preferred embodiment of the invention showing the terminal edges of the device snapped together to retain the same in the form of a tubular plastic annulus.

The blousing block 10 of the invention is preferably manufactured of a rectangular springy sheet of plastic 11 which is about ⅛ of an inch thick, five inches wide and from seventeen to 21 inches long (to provide a variety of sizes). The block is preferably injection molded, or extruded, with sheet 11 forming a split annulus with an axial length of five inches and invested with an elastic constrictive bias which presses together opposite ends of sheet 11. The manufacturing process also incorporates in one of said sheet ends a slotted female locking receptacle 12 and in the other of said sheet ends a headed male locking element 13. These elements are co-extensive with said sheet ends and are brought into contact by the spring bias with which the device is invested in the manufacturing process.

Figure 2:
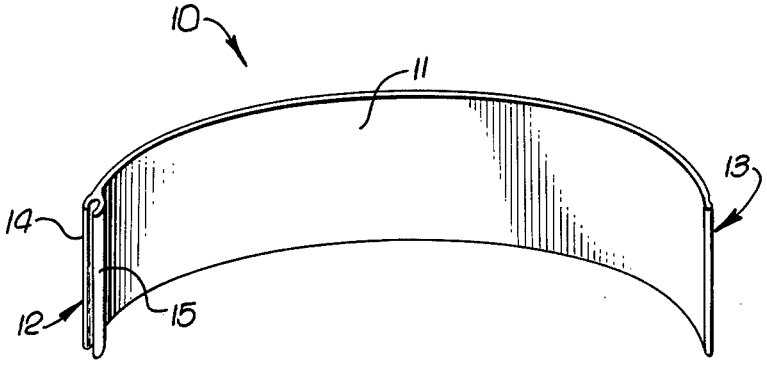
FIG. 2 is a view similar to FIG. 1 showing the terminal edges sprung apart and the entire device extended for assembly about a soldier's leg.
Figure 4:
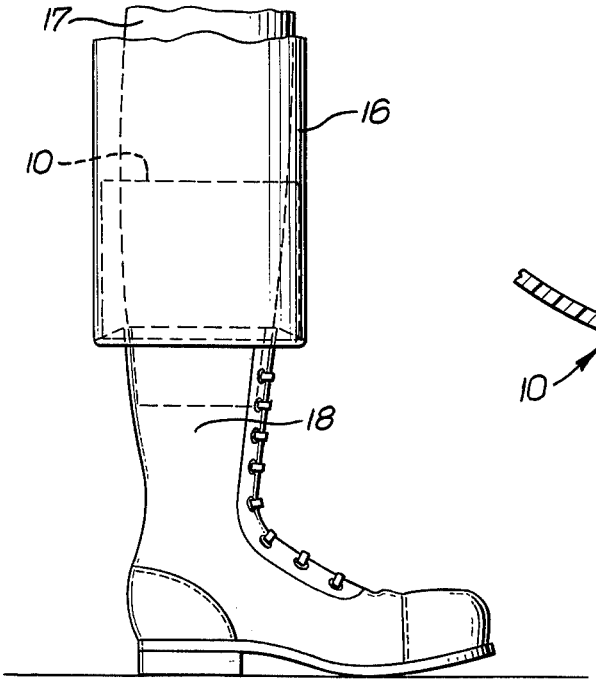
FIG. 4 is a side elevational view of a soldier's leg enclosed in pantsleg and boot with the pantsleg tucked into the boot and the latter laced up and with the pantsleg blousing blocked by the invention being enclosed in the pantsleg encircling the soldier's leg just above the level of the boot top.
Figure 3:
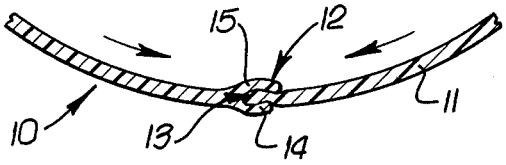
FIG. 3 is an enlarged detail sectional view taken on the line 3—3 of FIG. 1 showing the male-female interlocking means provided on opposing terminal edges of the invention.

The springy elasticity of the plastic sheet 11 of the blousing block 10 of the invention is such as to permit its two ends to be manually pulled away from each other as shown in FIG. 2 in fitting the block 10 around a leg of a soldier or in removing the block from around said leg. After releasing said ends to allow block 10 to encircle the leg with the locking elements 12 and 13 biased into contact with each other, the block is compressed between the two hands causing the headed male locking element 13 to penetrate and snap into place between the wings 14 and 15 of the receptacle element 12. This manual interlocking of the ends of the split annulus formed from plastic sheet 11 gives said annulus a rigidly united character while serving its purpose as a blousing block for a soldier's pantsleg 16.

OPERATION

The application of the invention to a soldier's leg 17, as above described, generally follows the soldier dressing but precedes the lacing of his boots 18. A pair of blousing blocks 10 are required for each soldier and each is applied as follows:

A pantsleg 16 is pulled up on the calf of a leg 17. A blousing block 10 is then applied around that leg just below that pantsleg and its end edges latched together. Said pantsleg 16 is then pulled down over said blousing block 10 and tucked into the ankle portion of the boot 18 worn on the foot of that leg 17. That boot 18 is then laced up and the blousing block 10 within said pantsleg 16 is allowed to gravitate to the level of the top end of said boot where it comes to rest on said pantsleg 16 and dresses the same. The other blousing block 10 is, of course, applied in the same manner to the other leg.

Removal of the two blousing blocks 10 when undressing is readily accomplished by inserting a finger between each leg 17 and the blousing block 10 encircling the same thereby unsnapping the locking means 12–13 which permits the plastic annulus formed by the device to be readily expanded and slipped off the leg.

Another advantage of the present invention is that it can be applied or removed from the legs inside the pantsleg 16 while the lower portions of the latter are held tightly tucked into the laced boot tops merely by briefly unbelting and unzipping the pants and dropping them to the floor.

It is preferable, to prevent the invention irritating the skin, that, in the manufacture thereof, upper and lower edges and all corners of plastic sheet 11 be rounded.

I claim:

1. A military serviceman's pantsleg blousing block comprising:

a split tubular annulus fitting around the leg within a pantsleg just above the top of a boot to gravitate onto said pantsleg to dress the same after the lower end of said pantsleg is tucked into the top of said boot and the latter laced up, said annulus being integral and invested with a degree of elasticity which spring biases the split ends thereof into engagement when released but permits a gap to be temporarily produced manually between said ends through which the ankle of a leg may be passed in the application of said block to or its removal from said leg, receptacle means being provided along one of said annulus ends, said means receiving the other of said annulus ends to interlock therewith and closing the split in said annulus, said receptacle means being provided with flexible wings enclosing a pocket co-extensive therewith, said other end of said split annulus being provided with a beaded edge adapted to expand said wings and enter said pocket with a snap action thereby locking said annulus ends together until manually sprung apart.

* * * * *